US005692328A

United States Patent [19]

Pettit

[11] Patent Number: 5,692,328

[45] Date of Patent: Dec. 2, 1997

[54] FLAG WAVING APPARATUS

[76] Inventor: Frank D. Pettit, 696 Fairway Dr., Union, N.J. 07083-8711

[21] Appl. No.: 425,087

[22] Filed: Apr. 19, 1995

[51] Int. Cl.[6] ..... G09F 17/00

[52] U.S. Cl. ..... 40/218; 40/414; 116/173

[58] Field of Search ..... 40/218, 414, 423, 40/427, 429; 116/173; 74/48

[56] References Cited

U.S. PATENT DOCUMENTS

| | | | |
|---|---|---|---|
| 2,284,209 | 5/1942 | Holm | 116/173 |
| 2,302,524 | 11/1942 | Borregard | 116/173 |
| 3,995,580 | 12/1976 | Serrone | 116/173 |
| 4,009,534 | 3/1977 | Brodt | 40/414 |
| 4,461,234 | 7/1984 | Bounds | 116/173 |
| 4,800,834 | 1/1989 | Feng | 116/173 |

*Primary Examiner*—Kenneth J. Dorner
*Assistant Examiner*—Cassandra Davis
*Attorney, Agent, or Firm*—Rohm & Monsanto

[57] ABSTRACT

An apparatus for displaying a flag, banner, or pennant, so as to simulate waving in wind, is particularly adapted for use with a novelty flag that is scaled for use in model railroad layouts. The apparatus employs a correspondingly scaled flag staff for coupling with and supporting the flag along one edge thereof. A drive arrangement is coupled to the flag staff at the base thereof for producing a rotatory oscillating motion. Electrical energy for the drive arrangement, which includes a small electric motor having a motor shaft with an eccentric element attached thereto, is provided from a conventional energy source, such as batteries. Coupling between the flag staff and the drive arrangement is achieved via a mechanical energy storage device that includes a resilient spring arranged to receive mechanical energy from the drive arrangement. The eccentric element attached to the motor shaft includes a mechanical striker that is in the form of a spring wire wound about the motor shaft. Mechanical energy stored in the mechanical energy storage device is delivered to the flag staff via a drive coupler that is coupled to the mechanical energy storage arrangement. The mechanical energy received by the mechanical energy storage arrangement is converted to the rotational oscillatory motion of the flag staff, the rotational oscillations being of such frequency and amplitude to induce an undulation in the novelty flag, whereby the flag is raised from its draped orientation so as to extend outwardly, giving the appearance of being supported by the wind.

19 Claims, 2 Drawing Sheets

FLAG WAVING APPARATUS

BACKGROUND OF THE INVENTION

1. Field of the Invention

This invention relates generally to animated models, and more particularly, to an arrangement for producing a realistic waving effect in a novelty flag, banner, or pennant.

2. Description of the Related Art

A variety of approaches have been taken in the prior art toward achieving the appearance of a flag or pennant waving in the wind. There is a need for an arrangement which achieves a realistic flag-waving appearance, particularly in miniature and model flag displays which are scaled to conventional model railroads.

In an early arrangement, a waving effect in a novelty flag was sought to be achieved by installing a flexible rod-like element in a hem along a vertical edge of the flag, and installing a support rod in a hem along the upper edge. In this known flag display arrangement, the flag is mounted onto a staff by being coupled thereto at the corner where the upper support rod and the vertical flexible rod-like element come together, and at the lower end of the flexible rod-like element. The lower end of the staff is coupled to an electric vibrator unit, whereby the vibrations therefrom are transmitted along the staff to the flag which is supported in an extended deployment by the upper support rod. The vibrations produce ripples in the flag to approximate the appearance of wind blowing thereon. However, the flag is maintained in an outwardly extended position by the support rod.

In a further known arrangement directed toward achieving the appearance of a waving flag, the flag is mounted on a staff and the upper outermost corner thereof is supported in the air by a diagonal rod. The diagonal rod is connected at its lower end to a solenoid arrangement which moves the rod upward and downward, causing a corresponding motion at the distal tip of the flag. In addition to failing to produce a realistic flag-waving motion, the known arrangement uses the flag itself to conceal the operating mechanism, and therefore, the apparatus can be displayed from only one side.

In a still further known device for displaying a flag in a waving condition, an elongated rod-like support is coupled to a flag staff at one end thereof, and is coupled to the flag itself along its upper edge, such as by folding and stitching. The rod-like support member is then bent so that the flag has a static wave. The flag staff is coupled to a motor arrangement which causes same to oscillate rotatively, whereby the supported flag is essentially wagged.

None of the known arrangements provide a realistic waving action for a flag, banner, or pennant. In addition, there is a need for a flag waving apparatus that permits the flag to hang naturally when the unit is not activated and, upon activation, causes the flag to perform a realistic flag waving action.

It is, therefore, an object of this invention to provide a flag or pennant waving arrangement wherein the flag or pennant hangs downwardly in a natural fashion when the apparatus is not activated, and which achieves a realistic flag waving action when the apparatus is activated.

It is another object of this invention to provide an arrangement for producing a waving effect in a web configured as a flag or pennant which is scaled to conventional model trains.

It is also an object of this invention to provide an arrangement for producing a waving effect in a web configured as a flag or pennant which is scaled to be engaged with a cap or hat.

It is a further object of this invention to provide a flag waving arrangement which does not require a stiffening member coupled to the web of the flag.

It is additionally an object of this invention to provide a waving system for a scale model flag, banner, or pennant, wherein the flag or pennant hangs downward when the waving system is deactivated, and assumes a substantially horizontal waving position upon actuation of the waving system.

It is yet a further object of this invention to provide a scale model flag waving arrangement which can be operated using conventional flashlight batteries and which does not require power from the mains.

It is also another object of this invention to provide a model flag waving apparatus which employs a simple and economical flag, banner, or pennant element made of a web of inexpensive, commercially available material.

It is yet an additional object of this invention to provide an actuating mechanism for a scale model flag waving apparatus wherein mechanical energy sufficient to create a realistic flag waving action is obtained using a low power motor powered by conventional flashlight batteries.

SUMMARY OF THE INVENTION

The foregoing and other objects are achieved by this invention which provides, in accordance with a first apparatus aspect thereof, a web waving apparatus of the type having a longitudinal shaft member which is oscillated rotatably. In accordance with the invention, a web is coupled at one end of the longitudinal shaft member. At the other end of the shaft member is provided a drive arrangement which is coupled thereto for rotatably oscillating same. The oscillations are of such frequency and amplitude as to induce a wave in the web, the wave being propagated along the web in a direction which is substantially transverse to a longitudinal axis of the longitudinal shaft member.

Preferably, the wave which is induced in the web forms at least one corrugation-like undulation in the web. Such an undulation urges the web to extend outward in a manner which simulates waving in the wind, without requiring stiffening or support members.

In a preferred embodiment of the invention, the drive arrangement is provided with energy storage means for receiving energy from the drive arrangement and providing same to the longitudinal shaft member. More specifically, there is provided a coupler for coupling the energy storage arrangement to the longitudinal shaft member, and an energy imparting member coupled to the drive arrangement for delivering an impact energy to the energy storage arrangement. In a specific illustrative embodiment of the invention, the coupling arrangement is in the form of a spring-like element having a portion thereof wound about the longitudinal shaft.

The drive arrangement is provided with a motor, such as a small electric motor of the type which is operable with energy supplied from a conventional battery source. The motor has a drive shaft, and the energy imparting element is in the form of an eccentric element coupled to the drive shaft. In one embodiment, the energy imparting element is in the form of a further spring element coupled to the motor shaft.

In a practical embodiment of the invention, the web, which is configured in the form of a flag, banner, or pennant, can be formed of a polymeric material, such as a sheet plastic similar to that employed in commercially available plastic tablecloths, having a thickness of approximately between 0.002 inches and 0.008 inches, and preferably approximately between 0.003 inches and 0.005 inches.

In an embodiment of the invention wherein the webbed material has a thickness of approximately 0.006 inches, the web is configured substantially as a rectangle dimensioned approximately between 2.5 inches and 5 inches along the end thereof coupled to the shaft member, and extending transversely thereto for approximately between 3 inches and 5.5. inches. In a practical embodiment of the invention, a scale model flag has a web thickness of approximately 0.003 inches and is dimensioned as a rectangle having a length of approximately 3.25 inches along the edge which is coupled to the shaft member, and a length of approximately 4.25 inches extending outwardly therefrom.

In accordance with a further apparatus aspect of the invention for displaying a novelty flag in a condition which simulates waving in the wind, the apparatus is provided with a staff for supporting the novelty flag, and coupling means for fixing the novelty flag along one end thereof to the staff. A drive is provided for producing an oscillatory motion, and a mechanical energy storage arrangement is provided to receive mechanical energy from the drive. A staff drive coupling arrangement is coupled to the mechanical energy storage arrangement, whereby the mechanical energy received by the mechanical energy storage arrangement is converted to rotational motion of the staff. The rotational motion which is imparted to the flag is of such frequency and amplitude as to induce an undulation in the novelty flag which will cause it to deploy itself in a waving condition.

In accordance with a specific embodiment of this further apparatus aspect of the invention, the drive is provided with an energy source for storing a supply of energy, and a motor which is coupled to the energy source for receiving the supply of energy. The motor has a motor shaft which produces a rotatory motion, and an eccentric element is coupled to the motor shaft for producing the oscillatory motion in response to the rotatory motion of the motor shaft. The mechanical energy storage arrangement is provided with a resilient spring element which stores and releases pulses of mechanical energy delivered to the mechanical energy storage arrangement by the eccentric element. In some embodiments of the invention, the eccentric element may be in the form of a mechanical striker. In a practical embodiment of the invention, the mechanical energy storage means is in the form of a length of spring wire wound around the staff. Similarly, the striker may be in the form of a further spring element coupled to the motor shaft.

In accordance with a method aspect of the invention, a method of producing a waving motion in a web to simulate a flag waving in wind includes the steps of:

coupling the web along an edge thereof to a vertical flag staff;

imparting pulses of mechanical energy to the vertical flag staff via a mechanical energy storage arrangement in a direction substantially transverse to the vertical flag staff, whereby the flag staff is rotatively oscillated; and propagating said pulses of mechanical energy along the vertical flag staff to the web coupled thereto, whereby an undulation is induced in the web.

In one specific illustrative embodiment of the invention of this method aspect, there are provided the further steps of rotating a shaft having a striker element thereon, and contacting periodically with the striker element a resilient element coupled to the vertical flag staff.

BRIEF DESCRIPTION OF THE DRAWING

Comprehension of the invention is facilitated by reading the following detailed description, in conjunction with the annexed drawing, in which.

DETAILED DESCRIPTION

Figure 1:
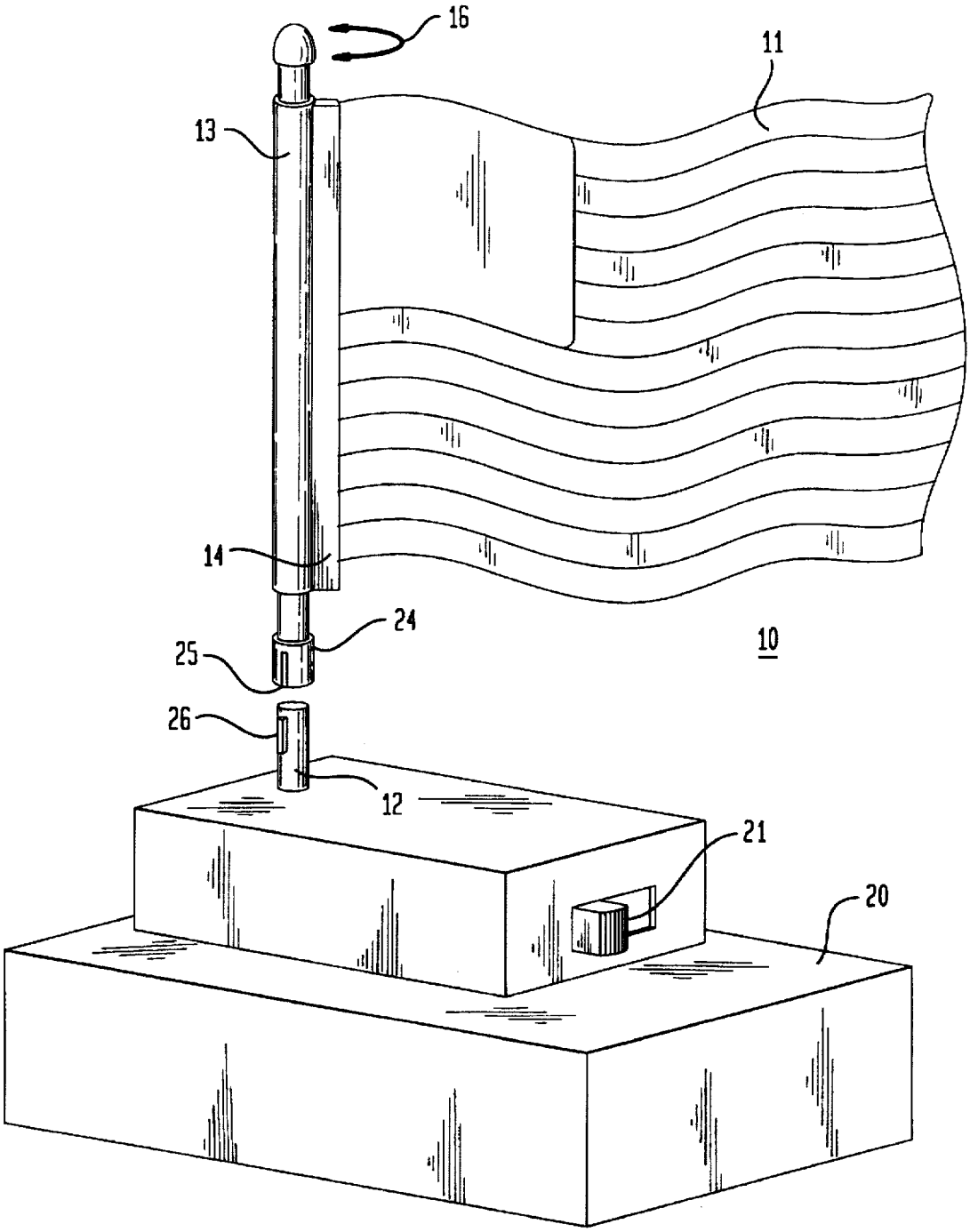
FIG. 1 is an isometric representation of a novelty flag waving device constructed in accordance with the principles of the invention.

FIG. 1 is an isometric representation of a novelty flag arrangement 10 having a web member 11 coupled to a flag staff 12. In this specific illustrative embodiment of the invention, coupling is achieved by a staff sleeve 13 having a sleeve extension 14 which is coupled to web member 11.

Staff sleeve 13 is fixed onto the flag staff so as to rotate therewith as the flag staff is caused to engage in rotational oscillation, in the directions shown by arrow 16.

As flag staff 12 and staff sleeve 13 are rotated back and forth, the resulting rotatory oscillation causes undulations to be induced in web member 11. As shown in the figure, the undulations in web member 11 appear as corrugations which travel outwardly therealong from the flag staff, and the web member is caused to elevate from a limp, draped orientation (not shown) to the waving condition shown in this figure.

Further as shown in FIG. 1, flag staff 12 is, in this specific embodiment of the invention, engaged with a base member 20 which contains a drive arrangement which will be described hereinbelow, and a source of electrical energy, such as conventional dry cell batteries (not shown in this figure). The source of electrical energy can, however, be in any appropriate form known to persons of skill in the art, such as direct power from the mains (not shown) or a conventional power supply arrangement.

In this specific illustrative embodiment of the invention, the flag staff is shown to be detachable from base member 20 by virtue of a coupler sleeve 24. As shown, the coupler sleeve is provided with a longitudinal slot 25 which engages with a protrusion 26 which extends radially outward of flag staff 12. This facilitates packing, storage, and shipping of the flag waving arrangement, as well as permitting changing of the flags, as desired.

An electrical switch 21 is provided for controlling activation and deactivation of the drive arrangement, as will be described hereinbelow.

Figure 2:
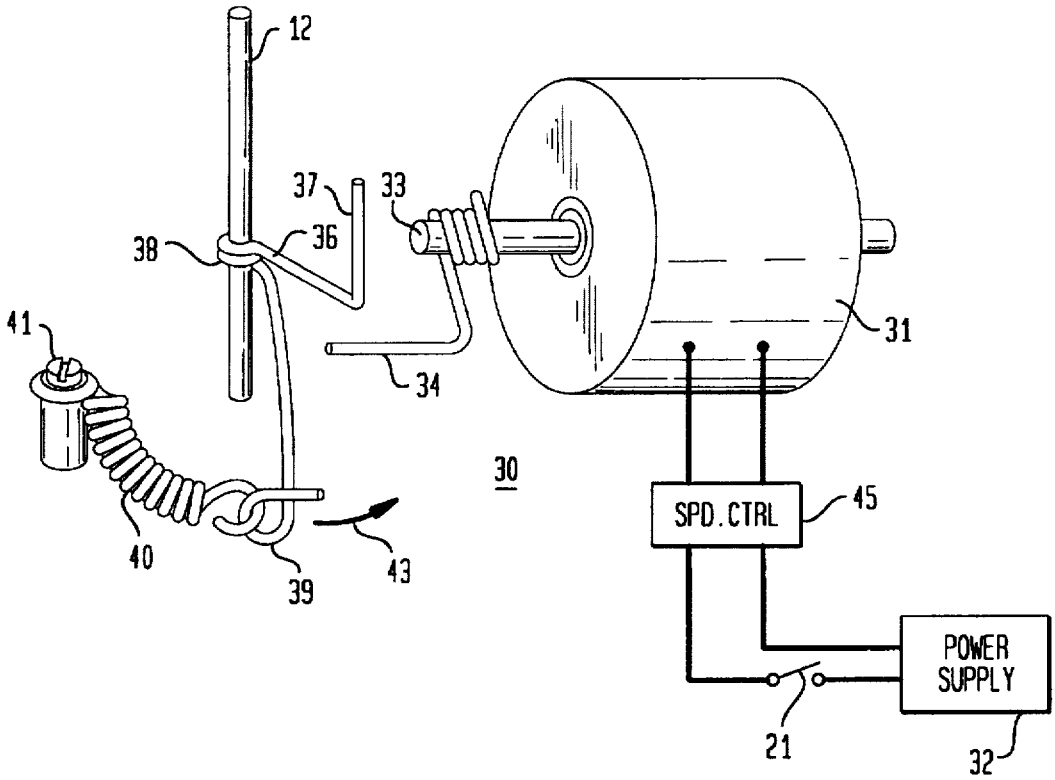
FIG. 2 is an isometric representation of a drive arrangement showing a resilient, mechanical energy storage system for coupling a drive motor to a flag staff and a source of electrical power.

FIG. 2 is an isometric representation of a drive arrangement 30 having a motor 31 which receives electrical energy from a supply 32 via electrical switch 21. Motor 31 has a motor shaft 33 about which is wound a spring wire striker element 34. In certain embodiments, the spring wire striker element is a preformed part, which functions as a cam. As shown, the windings of spring wire striker element 34 which surround the motor shaft form a fixed coupling thereto, whereby the striker element is rotated with the motor shaft when electrical switch 21 is closed.

In this illustrative embodiment, there is additionally provided a resilient spring wire element 36 which is shown to be wound around flag staff 12. In certain embodiments of the invention, the spring wire element is preformed and configured to have an arm 37; windings 38, with flag staff 12 arranged therethrough; and a loop 39. As shown, the windings of spring wire element 36 are directed about flag staff 12 so as to increase the tightening effect thereon as spring wire striker element 34 strikes arm 37. A tension spring 40 is coupled at one end thereof to loop 39, and at its other end is secured so as to be immovable, illustratively by a screw fastener 41.

In one specific illustrative embodiment of the invention, spring wire element 36 is installed onto flag staff 12 by pressing the legs thereof which bear arm 37 and loop 39 together. This action opens windings 38 sufficiently to allow same to be installed on, and mover along, flag staff 12. When the legs are released, the windings tend to return to their original dimension, thereby tightening around the flag staff. A similar procedure can be employed to install spring wire striker element 34 onto motor shaft 33.

In operation, the rotation of motor shaft 33 causes striker element 34 to communicate periodically with arm 37 of spring wire element 36. In a specific illustrative embodiment of the invention, the point along flag staff 12 where windings 38 are disposed is sufficiently below the central axis (not shown) of motor shaft 33 to ensure that the striker element communicates with arm 37. In a practical embodiment of the invention, windings 38 are disposed approximately ⅛" below the elevation of motor shaft 33, with respect to the longitudinal dimension of the flag staff. The communication between the striker element and the arm causes the spring wire element to be moved in the direction of arrow 43, causing an extension of tension spring 40. The motion of the spring wire element causes a corresponding rotation of flag staff 12. As the striker element moves away from arm 37, the mechanical, or potential, energy stored in tension spring 40 urges the spring wire element to return to its original position by urging same in a direction opposite to that indicated by arrow 43. Flag staff 12 is therefore rotatably oscillated, causing the undulations in web member 11 discussed hereinabove with respect to FIG. 1.

Referring once again to FIG. 2, it should be noted that striker element 34 is not always in communication with arm 37 of spring wire element 36. The rotation of the motor shaft, in some embodiments, causes striker element 34 to strike arm 37, whereby the rotation induced in flag staff 12 has a pulsed characteristic.

FIG. 2 further shows a speed control arrangement 45 which, in this specific illustrative embodiment of the invention, is electrically coupled to motor 31 and controls the operating speed thereof. The speed control arrangement facilitates, in some embodiments, user adjustability over the operating speed, thereby facilitating the waving flag effect to be controlled to simulate wind conditions of various strengths. Persons of skill in the art would, in light of the teaching herein, be able to configure the electrical characteristics of speed control arrangement 45 to achieve the desired range of speed control over the operation of the motor.

Figure 3:
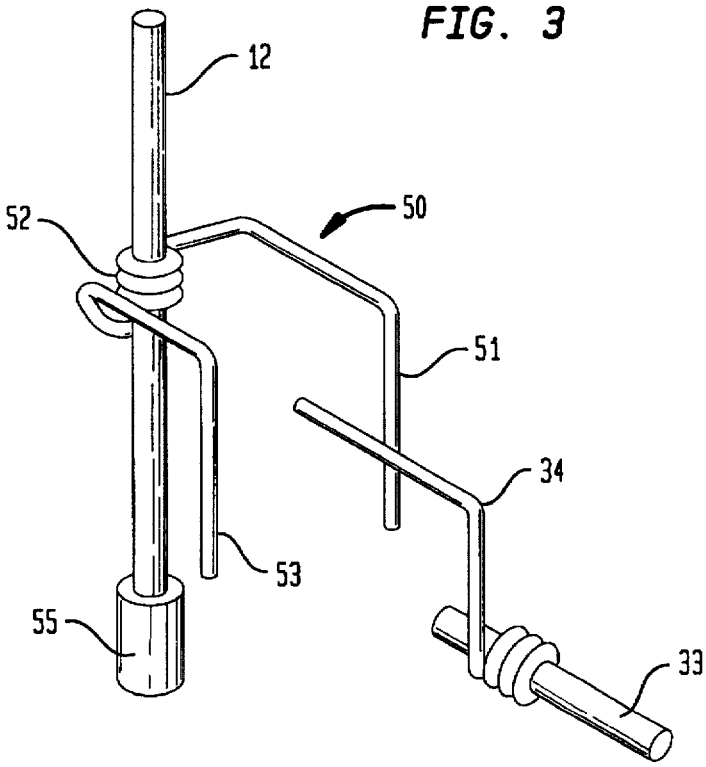
FIG. 3 is an isometric representation of a further mechanical energy storage system for coupling the drive motor to the flag staff.

FIG. 3 is an isometric representation of a further embodiment of a drive coupling arrangement. Elements of structure which bear correspondence to elements described hereinabove are similarly designated. In the embodiment of FIG. 3, a spring wire element 50 having an arm 51, a plurality of windings 52, and a further arm 53 is installed on flag staff 12, the arms being arranged on either side of striker arm 34, as, shown. Arms 51 and 53 are sufficiently long so that as motor shaft 33 is rotated, striker 34 strikes arms 51 and 53 alternatingly on their respective inward facing sides, causing rotatory oscillation in flag staff 12. The arms of spring element 50 are formed, as indicated, of spring wire, and therefore store some of the mechanical energy transmitted thereto in pulses as they are struck by striker element 34. In this embodiment, flag staff 12 is shown to be installed in a bearing 55 which permits the rotatory motion of flag staff 12 and additionally serves as a supporting thrust bearing.

In some embodiments of the invention, windings 52 are wound in a direction counter to that shown in FIG. 3. The striking of arms 51 and 53 by striker 34 would tend, therefore, to increase the tightening effect of windings 53 about flag staff 12. It is to be noted, however, that spring element 50 maintains a resilient effect at arms 51 and 53, and their respective portions which connect them to the windings, by virtue of such arms and portions being formed of spring wire.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A web waving apparatus of the type having a longitudinal shaft member which is oscillated rotatably, the apparatus comprising:

a web coupled at one end thereof to the longitudinal shaft member;

drive means for for inducing the rotatory oscillation of the longitudinal shaft member, the oscillations being of such frequency and amplitude as to induce a wave in the web in a direction substantially transverse to a longitudinal axis of the longitudinal shaft member; and energy storage means coupled to the longitudinal shaft member for receiving energy from said drive means and providing the energy to the longitudinal shaft member.

2. The web waving apparatus of claim 1, wherein the wave induced in said web forms at least one corrugation-like undulation in said web.

3. The web waving apparatus of claim 1, wherein said drive means comprises:

coupling means for coupling said energy storage means to the longitudinal shaft member; and energy imparting means coupled to said drive means for delivering an impact energy to said energy storage means.

4. The web waving apparatus of claim 3, wherein said coupling means comprises a spring element having a portion thereof wound about the longitudinal shaft member.

5. The web waving apparatus of claim 3, wherein said drive means comprises a motor having a drive shaft, and wherein said energy imparting means comprises an eccentric element coupled to said drive shaft.

6. The web waving apparatus of claim 5, wherein said drive means further comprises a speed control means coupled to said motor for controlling the operating speed thereof.

7. The web waving apparatus of claim 5, wherein said energy imparting means comprises a further spring element coupled to said motor shaft.

8. The web waving apparatus of claim 1, wherein said web is formed of a polymeric material having a thickness of approximately between 0.002" and 0.008".

9. The web waving apparatus of claim 1, wherein said web is configured substantially as a rectangle dimensioned approximately between 2.5" and 5" along said end coupled to the shaft member, and extending transversely thereto for approximately between 3" and 5.5".

10. The web waving apparatus of claim 1, wherein said web is configured to have a substantially triangular configuration.

11. Apparatus for displaying a novelty flag in a condition simulating waving in wind, the device comprising:

staff means for supporting the novelty flag;

coupling means for fixing the novelty flag along one end thereof to said staff means;

drive means for producing an oscillatory motion;

mechanical energy storage means arranged to receive mechanical energy from said drive means; and staff drive coupling means coupled to said mechanical energy storage means whereby said mechanical energy received by said mechanical energy storage means is converted to rotational motion of said staff means, said rotational motion being of such frequency and amplitude to induce an undulation in the novelty flag.

12. The apparatus of claim 11, wherein said drive means comprises:

an energy source for storing a supply energy;

motor means coupled to said energy source for receiving said supply energy;

a motor shaft coupled to said motor means for producing a rotatory motion; and eccentric means coupled to said motor shaft for producing the oscillatory motion in response to the rotatory motion of said motor shaft.

13. The apparatus of claim 12, wherein said mechanical energy storage means comprises a resilient spring element for storing and releasing pulses of mechanical energy delivered to said mechanical energy storage means by said eccentric means.

14. The apparatus of claim 12 wherein said eccentric means comprises a mechanical striker means.

15. The apparatus of claim 14, wherein said mechanical energy storage means comprises a preformed length of spring wire wound around said staff means.

16. The apparatus of claim 15, wherein said striker means comprises a spring element coupled to said motor shaft.

17. A method of producing a waving motion in a web to simulate a flag waving in wind, the method comprising the steps of:

coupling the web along an edge thereof to a vertical flag staff;

imparting pulses of mechanical energy to the vertical flag staff via a mechanical energy storage arrangement in a direction substantially transverse to the vertical flag staff, whereby the flag staff is rotatively oscillated; and propagating said pulses of mechanical energy along the vertical flag staff to the web coupled thereto, whereby an undulation is induced in the web.

18. The method of claim 17, wherein said step of imparting pulses of mechanical energy comprises the further steps of:

rotating a shaft having a striker element thereon; and contacting periodically with the striker element a resilient element coupled to the vertical flag staff.

19. The method of claim 18, wherein there is provided the further step of controlling the speed of rotation of said shaft.

* * * * *